United States Patent [19]

Martin

[11] 4,321,824

[45] Mar. 30, 1982

[54] HIGH ENERGY LASER TARGET BOARD

[75] Inventor: Robert C. Martin, Huntsville, Ala.

[73] Assignee: The United States of America as represented by the Secretary of the Army, Washington, D.C.

[21] Appl. No.: 170,330

[22] Filed: Jul. 21, 1980

[51] Int. Cl.[3] ..... G01S 5/12

[52] U.S. Cl. ..... 73/190 EW; 250/349

[58] Field of Search ..... 73/190 EW, 190 H; 136/213, 224, 225; 250/349, 352

[56] References Cited

U.S. PATENT DOCUMENTS

| | | | |
|---|---|---|---|
| 2,938,122 | 5/1960 | Cole | 73/190 |
| 3,232,113 | 2/1966 | Malone | 73/190 |
| 3,280,626 | 10/1966 | Stempel | 73/190 |
| 3,382,714 | 5/1968 | Miller et al. | 73/190 |
| 3,424,624 | 1/1969 | Villers | 136/213 |
| 3,738,168 | 6/1973 | Mansell | 73/190 |
| 3,939,706 | 2/1976 | Pinson | 73/190 |

OTHER PUBLICATIONS

Gardon, "An Instrument for Measurement of Intense Thermal Radiation", In Review of Scientific Inst., vol. 24, No. 5, 5/53, pp. 366–370.

*Primary Examiner*—Herbert Goldstein

*Attorney, Agent, or Firm*—Nathan Edelberg; Robert P. Gibson; Robert C. Sims

[57] ABSTRACT

The target board has an array of discs calorineters spread around the surface to receive the laser energy. The energy striking a disc is sensed by a pair of thermal leads connected to the back side of the disc and the voltage cross the lead is amplified and sent to a recording system.

3 Claims, 4 Drawing Figures

HIGH ENERGY LASER TARGET BOARD

DEDICATORY CLAUSE

The invention described herein was made in the course of or under a contract or subcontract thereunder with the Government and may be manufactured, used, and licensed by or for the Government for governmental purposes without the payment to me of any royalties thereon.

BACKGROUND OF THE INVENTION

The development of high-energy lasers, such as might be used in a military weapons system, has caused the need to accurately measure the characteristics of the beam. The characteristics to be measured are beam position, power distribution, and the variation of power distribution with time. The device herein disclosed, referred to as a "target board", is designed to make these measurements by making absolute power level measurements at discrete points over the area of the laser beam. The power level measurements are responsive to rapid changes in either intensity or position of the laser beam.

DESCRIPTION OF THE BEST MODE AND PREFERRED EMBODIMENTS

Figure 2:
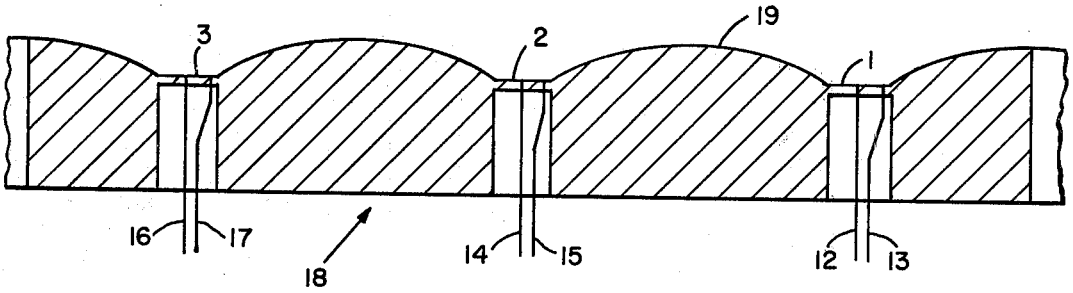
FIG. 2 is a cutaway view of the target board.
Figure 1:
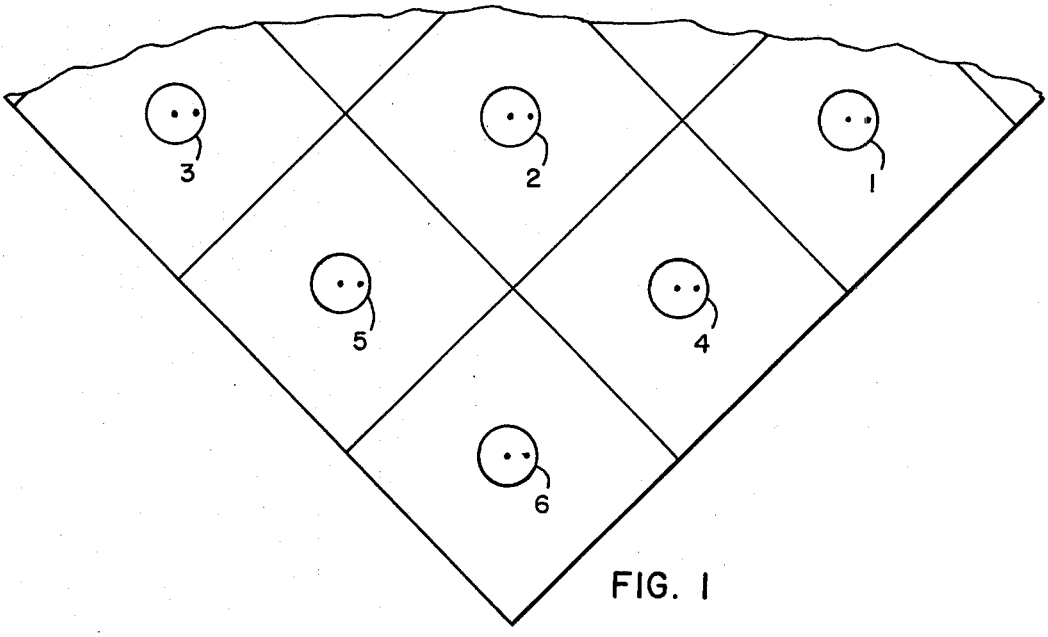
FIG. 1 is a front view of a portion of the target board.

FIGS. 1 and 2 show an array of closely spaced disc calorimeters 1–6, the discs of which are manufactured as an integral part of a large metal plate. The plate is made of a material which has the characteristics of high thermal conductivity, high diffusivity, and a constant thermal conductivity value with changing temperature. Certain alloys of copper best meet these requirements. Each calorimeter measures the laser power impinging upon its disc. The spacing between calorimeters is chosen for a given application such that the laser beam covers a large enough number of the calorimeters to ensure that the required information is obtained in sufficient detail.

The physical dimensions of the calorimeters are chosen so as to best meet the requirements of sensitivity and time response. The relationships are given by the follow empirical equations:

$$T.C. = K_1(PCp\ R^2/k)$$

$$E = K_2(qR^2/dk)$$

Where:

T.C. = Time Constant, time required to reach 63% of full response.

P = Density of plate material, $kg/m^3$.

Cp = Heat capacity of plate material, J/kgK.

R = Radius of calorimeter disc, meters.

k = Thermal conductivity of plate material, W/m·K.

E = Thermoscouple output voltage microvolts.

q = Input laser beam power density, $W/m^2$.

d = Calorimater disc thickness, meters.

$K_1 = 0.43$, approximately.

$K_2 = 5$, approximately with a copper plate and Chromel thermocouple leads.

Each calorimeter consists of the above mentioned disc, with two lead wires 12–17 attached, one to the center of the disc, and the other to the edge, preferably by electron beam welding. This arrangement is shown in FIG. 1.

The leads 12–17 are of a metal, or semiconductor material, which forms a thermocouple with the disc metal, preferably producing an output voltage which is linearily proportional to temperature. When copper is used as the disc material, the preferred lead metal is a nickel-chromium alloy, such as Chromel. The surface of each calorimeter which is exposed to the laser radiation may have a surface finish which is absorbent at the laser wavelength, so that the major portion of the laser energy is absorbed in the disc, causing a maximum rise in disc temperature for a given beam power. Alternatively, if power levels which would damage the disc, possibly through melting, are anticipated, then the surface may be made partially reflective, so that only a portion of the laser energy is absorbed.

In operation, the laser beam energy impinging upon the surface of the calorimeter disc causes the disc to rise in temperature. Due to the heat flow pattern inherent in the geometrical design of the calorimeter disc, the temperature of the center of the disc rises, above the temperature of the edge in direct porportion to the absorbed energy. The thermocouple junctions, one at the center and one at the edge of the disc, are effectively in series opposition. This causes the voltage between the two leads to be proportional to the temperature difference between the center and the edge of the disc, and thus proportional to the power intensity of the laser beam at the surface of the calorimeter.

While there is necessarily a secondary junction between the calorimeter thermocouple leads and a dissimilar metal (normally copper) at the points 21 and 22 (FIG. 3) at which they connect to an amplifier 24 or other detection device, these junctions are also in series opposition, and make no contribution to the output voltage as long as the junctions are at the same temperature. This is easily accomplished by making these connections close together and relatively far away from the target board calorimeters.

The front surface of the target board consists only partially of the calorimeter discs. Typically the disc would constitute 5% of the total surface area. For this reason, the remaining surface of the target board must be capable of either absorbing the laser energy impinging upon it, or of reflecting the energy. The main body of the board 18 is made of electrolytic tough pitch copper, a gold plated surface will make reflective. This disclosure covers two types of reflective target board surfaces, which may be described as (1) flat reflective and (2) diffusely reflective. The flat reflective board may be used to characterize a laser beam at the same time that a conventional target is being irradiated. The diffusely reflective board may be used to characterize a laser beam which is aimed directly at it. In this case, the greater part of the laser energy is reflected in a diffuse manner, so as to be harmless beyond a short distance from the target board. A particular design of a target board having an array of convex surfaces which will produce a diffuse reflection of the laser beam is shown in FIG. 2.

Figure 3:
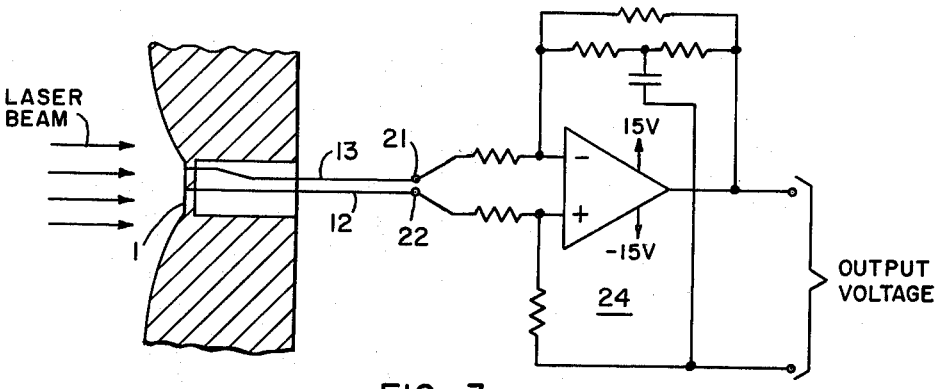
FIG. 3 is a schematic illustration of the connections to a target board.

Referring to FIG. 3 the output voltage of each calorimeter must be amplified to be useful, and this may be accomplished using a differential operational amplifier with a flat frequency response over the range of frequencies for which the disc calorimeter is useful. Alternatively and preferably, the frequency response of the operational amplifier 24 may be tailored to compensate for the thermal log in the calorimeter disc, and thus enhence the frequency response of the calorimeter output by a relatively large factor. For example, a calorimeter which has an inherent frequency response of 6Hz may be made to respond to frequencies of 60 Hz with the proper frequency compensation of the operational amplifier.

Figure 4:
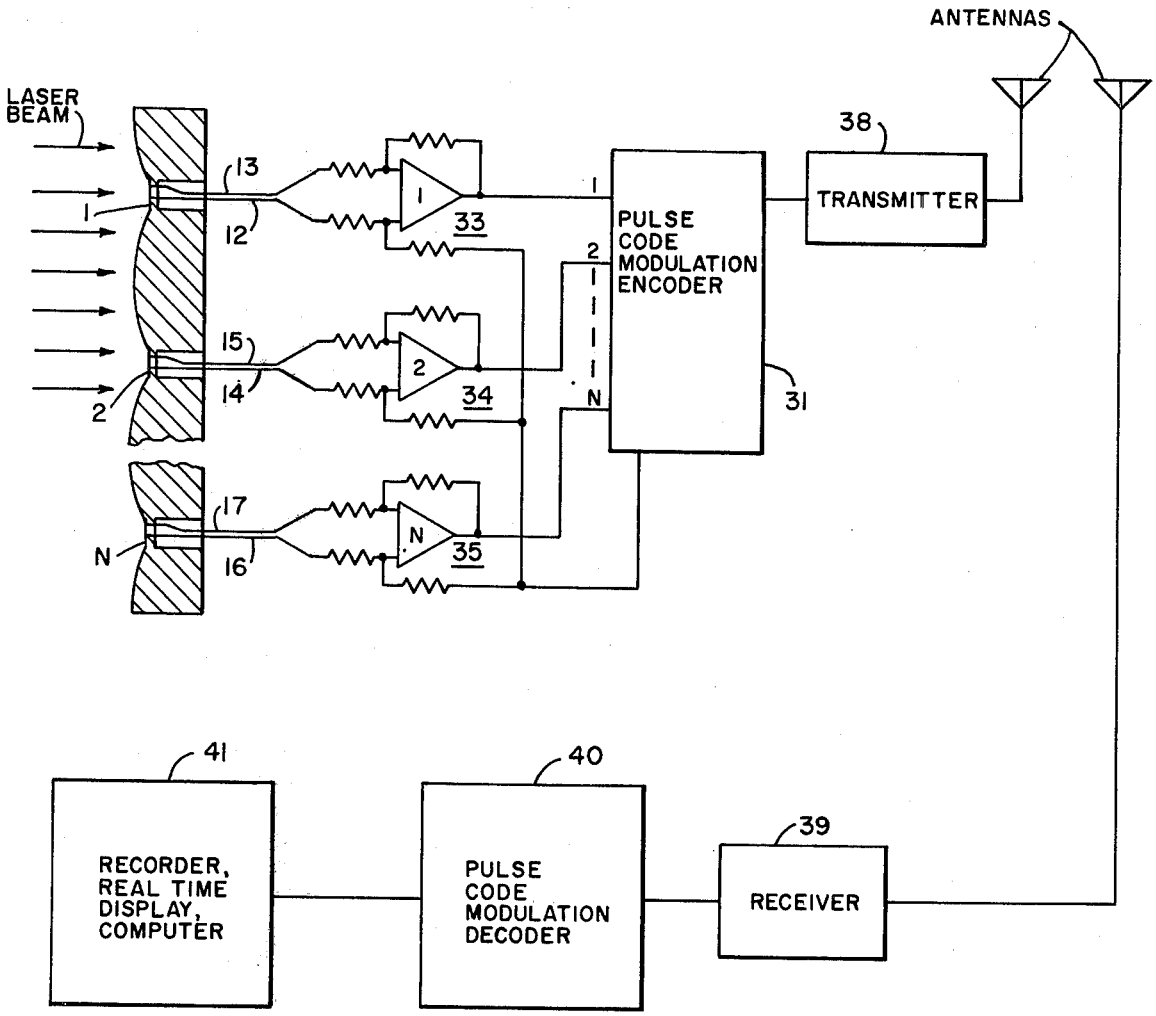
FIG. 4 is a schematic showing of the overall preferred mode of the present invention.

The outputs of the array of calorimeter-amplifier combinations which constitute the target board must typically by telemetered to a recording or display means. An accurate, easily implemented means for accomplishing this is the use of a commercially available PCM (pulse code modulation) encoder (see FIG. 4). This encoder will accept inputs from a number of calorimeter amplifiers 33–35. (Typically 256 arranged in a 16×16 array) and convert their outputs to a (typically 8 bit) digital format, and then output the digital information in a serial format, each of the inputs in sequence. The scan, or frame, rate used will depend upon the required frequency band width, telemetry requirements, etc. The serial bit stream may be used to modulate a telemetry transmitter whereby the information is transmitted by transmitter 38 to a receiving station 39, decoded by decoder 40, and presented to whatever presentation or recording means 41 are appropriate.

The new and novel features of the target board are the manufacturing method, whereby an array of disc calorimeters is fabricated as an integral part of a single metal plate; the material combination, wherein materials are chosen for the linearity of their thermoconductive and thermoelectric properties; the target board configuration, in which the front surface is shaped, by machining, casting, or whatever means, to reflect the majority of the impinging laser beam in a diffuse manner, so that the reflected laser power will be reduced to a harmless level a relatively short distance from the target board; and the combination of the disc calorimeter and an amplifier with compensating frequency characteristics. This combination produces a measuring device with a faster rise time, and a higher frequency response, than that of the calorimeter alone; it is therefore possible to optimize the design of the calorimeter for characteristics other than frequency response for the requirements of a given application.

I claim:

1. A device for sensing high electromagnetic energy radiation comprising a board having a plurality of individual sensing elements therein; said sensing element and said board are fabricated as an integral part of a single metal plate; said elements producing heat in response to said radiation striking it; said board acting as a heat sink for the edges of said elements such that the heat will flow from the center of the element to its edges in proportion to the intensity of the radiation; a plurality of thermocouples each having a pair of junctions; one junction connected to the center of each element and the other junction connected at the edge of the element so as to produce a voltage which is proportional to the heat flowing in said elements; and measurement means connected to each of said thermocouple junctions.

2. A device as set forth in claim 1 wherein the board configuration is shaped in such a manner to cause the reflection of the impinging radiation in a diffused manner, so that the reflected radiation will be reduced to a harmless level with a relative short distance of the board.

3. A device as set forth in claim 2 wherein said measurement means include a plurality of frequency compensating amplifier.

* * * * *